US011352176B1

(12) United States Patent
Sutton

(10) Patent No.: US 11,352,176 B1
(45) Date of Patent: Jun. 7, 2022

(54) LARGE APERTURE RESEALABLE CONTAINER HAVING QUICK TOOL-FREE ACCESS AND TAMPER-EVIDENT LOCKING FOR STACKABLE ASSEMBLY WITH LATERAL ENGAGEMENT

(71) Applicant: Jepson Sutton, Phoenix, AZ (US)

(72) Inventor: Jepson Sutton, Phoenix, AZ (US)

( * ) Notice: Subject to any disclaimer, the term of this patent is extended or adjusted under 35 U.S.C. 154(b) by 77 days.

(21) Appl. No.: 16/974,037

(22) Filed: Sep. 15, 2020

Related U.S. Application Data

(63) Continuation-in-part of application No. 16/160,983, filed on Oct. 15, 2018, now Pat. No. 10,918,982.

(51) Int. Cl.
*B65D 43/02* (2006.01)
*B65D 21/02* (2006.01)
*B65D 55/02* (2006.01)

(52) U.S. Cl.
CPC ..... *B65D 43/0231* (2013.01); *B65D 21/0202* (2013.01); *B65D 21/0223* (2013.01); *B65D 55/026* (2013.01); *B65D 2255/00* (2013.01); *B65D 2401/00* (2020.05); *B65D 2543/00972* (2013.01)

(58) Field of Classification Search
CPC ..... B65D 43/0231; B65D 21/0202; B65D 21/0223; B65D 55/026; B65D 2255/00; B65D 2401/00; B65D 2543/00972
USPC ..... 210/450, 244, 246, 455; 206/821; 220/23.6, 582, 200, 213, 229, 234, 240, 220/253, 254.1, 255, 256.1, 260, 288, 220/304, 780, 781, 795, 319
See application file for complete search history.

(56) References Cited

U.S. PATENT DOCUMENTS

| | | | | |
|---|---|---|---|---|
| 10,918,982 | B1 * | 2/2021 | Sutton | B01D 29/96 |
| 2008/0041781 | A1 * | 2/2008 | Goodman | B01D 29/01 210/477 |
| 2012/0318725 | A1 * | 12/2012 | Tseng | B01D 29/96 210/232 |

* cited by examiner

*Primary Examiner* — Madeline Gonzalez

(57) ABSTRACT

The invention disclosed is an intermediate-volume, dimensionally scalable container having a large transmural aperture providing easy access to contents and a resealable lid providing quick and repeated access to the contents. In one embodiment the invention provides a clear visible indication as to the locked or unlocked state of the lid and is adapted to readily incorporate different forms of tamper proof and tamper evident seals. The invention includes an assembly of similar containers of the same or different volumes having recessed bottom portions to receive the upper portion and lid of a vertically adjacent container when stacked and at least two opposing sides having complementary surface deformations to facilitate side-to-side mating of such containers when shipped, displayed for sale or stored.

19 Claims, 14 Drawing Sheets

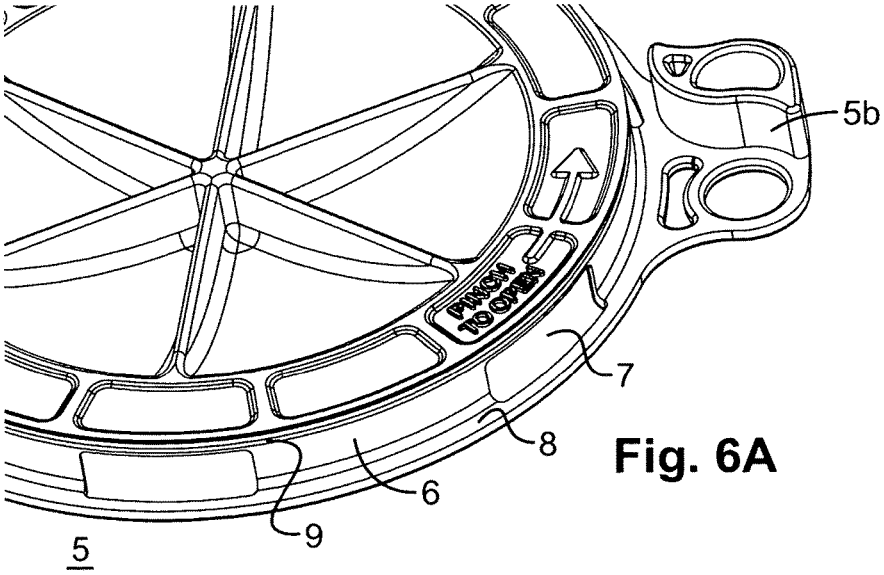
Fig. 6A
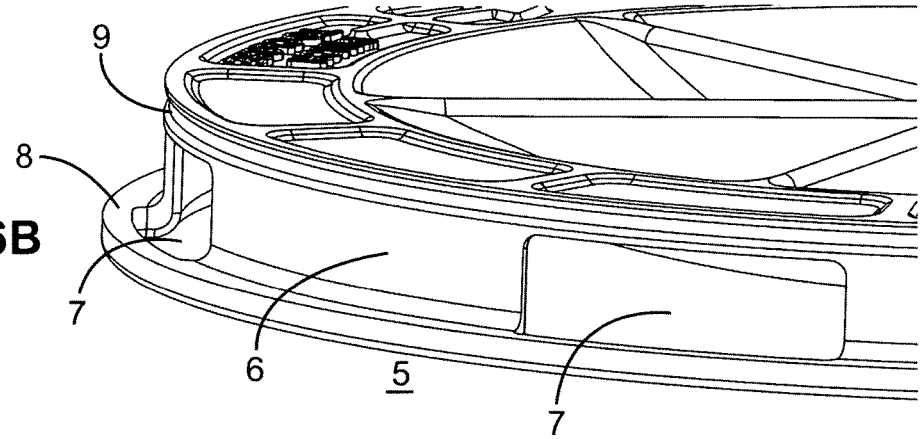
Fig. 6B
Fig. 6C
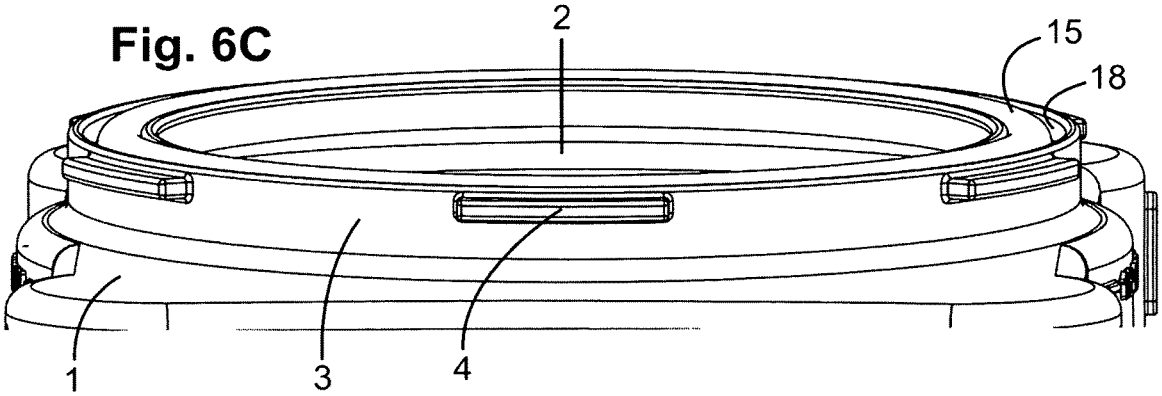

LARGE APERTURE RESEALABLE CONTAINER HAVING QUICK TOOL-FREE ACCESS AND TAMPER-EVIDENT LOCKING FOR STACKABLE ASSEMBLY WITH LATERAL ENGAGEMENT

RELATED APPLICATION & PATENTS

This is a continuation-in-part of Ser. No. 16/160,983 filed Oct. 15, 2018 and now U.S. Pat. No. 10,918,982, which was a continuation-in-part of Ser. No. 29/606,366 filed Jun. 3, 2017, Pat. No D832,394. These prior related applications are incorporated herein by reference and are relied on for disclosure of common features and prior art.

BACKGROUND

Field of Invention

The present invention relates to scalable, intermediate-volume containers for the distribution and storage of materials. More particularly the invention relates to such containers having large, quickly resealable apertures that can form stacked assemblies having limited lateral displacement between containers in contiguous top-to-bottom and side-by-side alignment.

Rigid Containers for Product Distribution and Storage

The history of rigid container technology dates back thousands of years and ranges in scope from the simplest reed basket to the most sophisticated manned space module. Rigid containers for product distribution and/or storage vary widely in size, shape and construction—from small glass vials to large steel shipping containers. Intermediate-size containers, in the range from about one pint to about 15 gallons present particular challenges due to (a) strength requirements dictated by content weight, (b) access and aperture requirements dictated by non-liquid contents and (c) resealing requirements dictated by the consumer's repeated partial use of the contents.

Single-use product containers typically have closures or lids that allow for one-time access to contents (like a soup can) in which the closure is useless after the initial opening. Other containers are available with many forms of lids that can be removed and replaced repeatedly over time (like detergent containers). Some resealable containers are produced and sold separately as generic storage containers (like 5-gallon buckets). Increasingly, manufacturers are seeking to deliver higher value products in containers that can be cleaned and reused by customers for the storage of other items or materials, thereby usefully recycling what would otherwise be a waste product.

Many containers require only a mechanical closure to secure solid non-perishable items. Some containers must be sealed against the entry of air or moisture to prevent premature staleness, spoilage or oxidation of the contents. Some containers may be sealed under vacuum after the contents (especially food products) have been processed and packaged at elevated temperature. Other containers are initially sealed with the contents under pressure (such as carbonated beverages). The size or shape of a container and the means for accessing the contents often depend on the physical character of the contents themselves, which may be solid articles, liquids of different viscosity, pastes or powders.

The type of resealable closures used on product and storage containers fall into several general categories. Probably the largest category is the simple screw-on cap or lid. Threaded caps are inexpensive and in smaller diameters they are easily mass produced and highly effective. However, as the diameter of these lids increases beyond about 3 inches, they exceed the gripping span or twisting strength of many ordinary users. With increasing diameter, these larger threaded lids become structurally more challenging, less effective at sealing and more difficult to open and close. For these reasons, larger threaded lids often require tools for opening and for reclosing; this is particularly true when the process of closure requires the establishment of an air-tight, water-tight or other atmospheric seal.

Air-tight containers—particularly those that must be frequently opened and resealed to access the container's contents—often include a sealing gasket between the closure and the container itself. Threaded closures are effective in compressing such gaskets; however, when threaded closures are tightened, they subject the gasket to over compression and circumferential shear, thereby reducing the sealing capacity, resilience and useful life of the gasket.

One of the earliest and most effective resealable containers that eliminates shear forces from the gasket is the so called "Mason Jar" named after its inventor John Mason and described in his early patents dating from the 1850s into the 1870s (e.g., U.S. Pat. Nos. 22,186 and 102,913). The Mason Jar includes a flat lid that covers the jar's aperture and compresses a gasket when a threaded collar is screwed down over a neck surrounding the aperture. Because the lid is separate, it does not rotate relative to the gasket and the gasket is not subject to shear, although it may still be subject to excess compression when the threaded collar over tightened. The aperture through which contents of a Mason Jar are accessed is typically limited to an inside diameter of about 3 inches or less to accommodate the normal range of hand size and strength required to loosen and tighten the threaded collar.

With intermediate size containers (up to about 15 gallons), it is often important that they be adapted for stacking on one another to form assemblies of containers for bulk shipping, retail display or longer-term storage without the use of shelving. While stacking can provide vertical linkage between adjacent containers, it does not link horizontally adjacent containers or stacks of containers. As a result, large assemblies of stacked containers are not optimally aligned and linked to allow for minimal wrapping and stable shipment as an assembled unit.

For some applications, containers must be adapted to incorporate a tamper proof or a tamper evident feature. In general, a tamper evident feature provides quick visible evidence that the container has been opened (or remains open) after accessing the contents. A tamper proof feature indicates whether the container has been opened after its initial filling and closure, particularly in the case of food, medical and high-value products. In the case of bulk products that are sensitive to environmental conditions, the containers used for delivery and storage are frequently opened and closed by the consumer. In cases where the contents are sensitive to environmental conditions and it is beneficial to have a seal-evident feature that provides the user with a clear visual indication that the container has been both reclosed and resealed.

OBJECTS OF THE INVENTION

One object of the invention is to provide a universal form of scalable container of intermediate volume having a large aperture that can be quickly opened and resealed without the use of tools. Another object of the invention to provide such a container with an external configuration that includes complementary upper and lower surfaces for vertical stacking and at least two opposing sides that are complementary for contiguous horizontal engagement of such containers during shipping and storage. It is a further object to provide such a container that is adapted to incorporate visual indicators of its initial sealed condition and of its resealed condition after any subsequent opening.

SUMMARY OF INVENTION

The invention described is an intermediate-volume, dimensionally scalable container having a large transmural aperture providing easy access to contents and a resealable lid providing quick and repeated access to the contents. In one embodiment the present invention further provides a clear visible indication as to the locked or unlocked state of the lid and is adapted to readily incorporate simple forms of tamper proof and tamper evident seals after the container has been filled with product for later distribution, sale, display or storage. The invention includes an assembly of similar containers of the same or different volumes having recessed bottom portions to receive the upper portion and lid of a vertically adjacent container when stacked and at least two opposing sides having complementary surface deformations to facilitate side-to-side mating of such containers when shipped, displayed for sale or stored.

DESCRIPTION OF THE DRAWINGS

FIGS. 6A through 6E are partial perspective views showing details of the lid (FIGS. 6A and 6B), the shoulder and pins on the top of the container (FIG. 6C), the inner portion of the collar with its inclined surfaces, stops and snap ridges (FIG. 6D) and the lid in place over the shoulder (without the collar) to show the spatial relation between the slots in the lid and the pins on the shoulder (FIG. 6E).

FIG. 9B shows only the lid and collar from the second (lower) container nested within the recessed area at the bottom of the first (upper) container.

FIG. 10A is a side view with a first of the two containers directly in front of the second container. FIG. 10B is a sectional end view of the two engaged containers taken at Section 10B-10B in FIG. 10A. FIG. 10C is an enlarged detail of the circled portion of FIG. 10B showing the complementary relation between one engaged pair of the complementary ribs and recesses on opposite sides and opposite ends of both adjacent containers.

DETAILED DESCRIPTION

Figure 1:
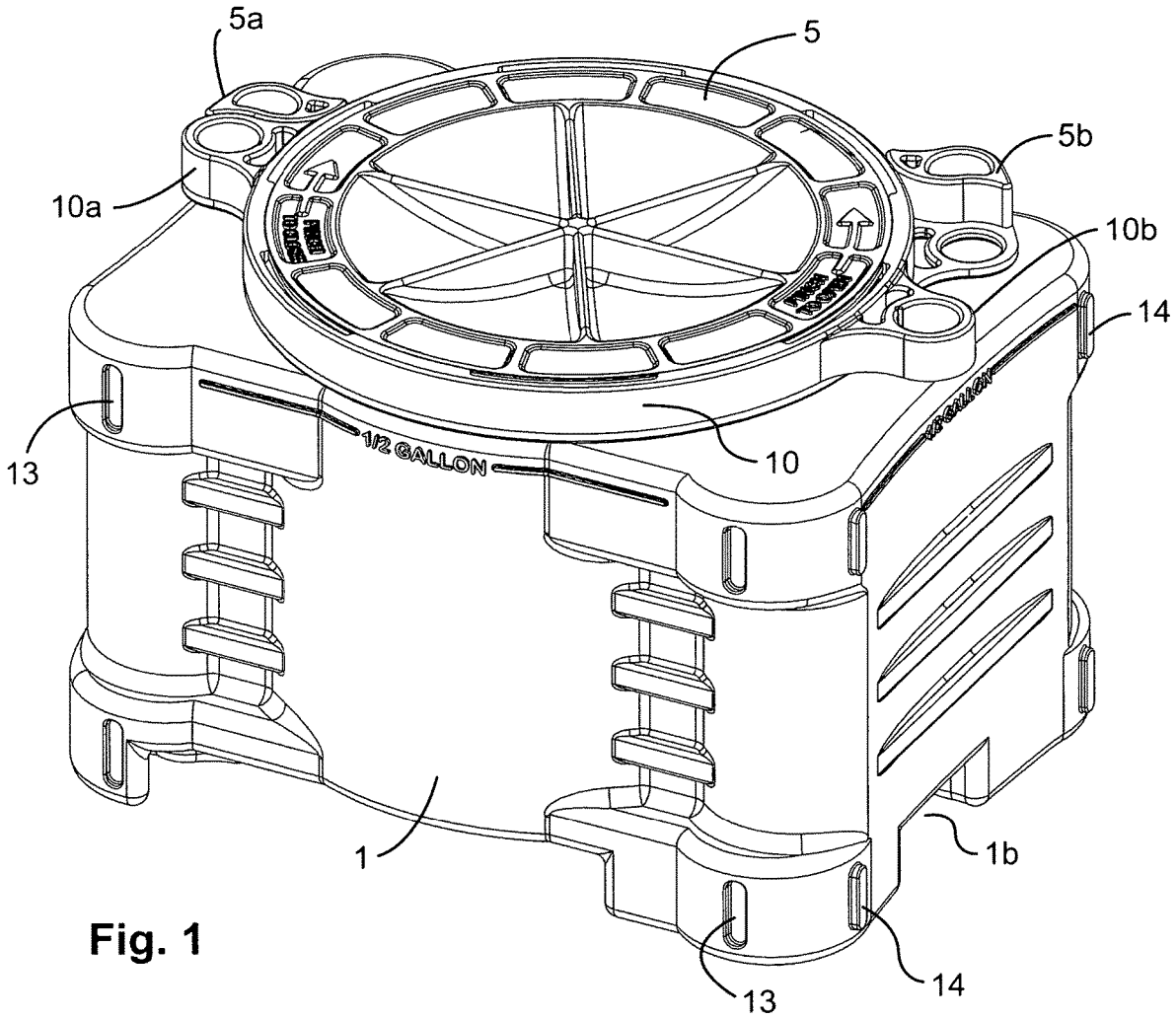
FIG. 1 is a perspective view of a rectangular container that embodies the invention and has been selected for detailed description. This particular container is scaled for an internal volume of one-half gallon.
Figure 2:
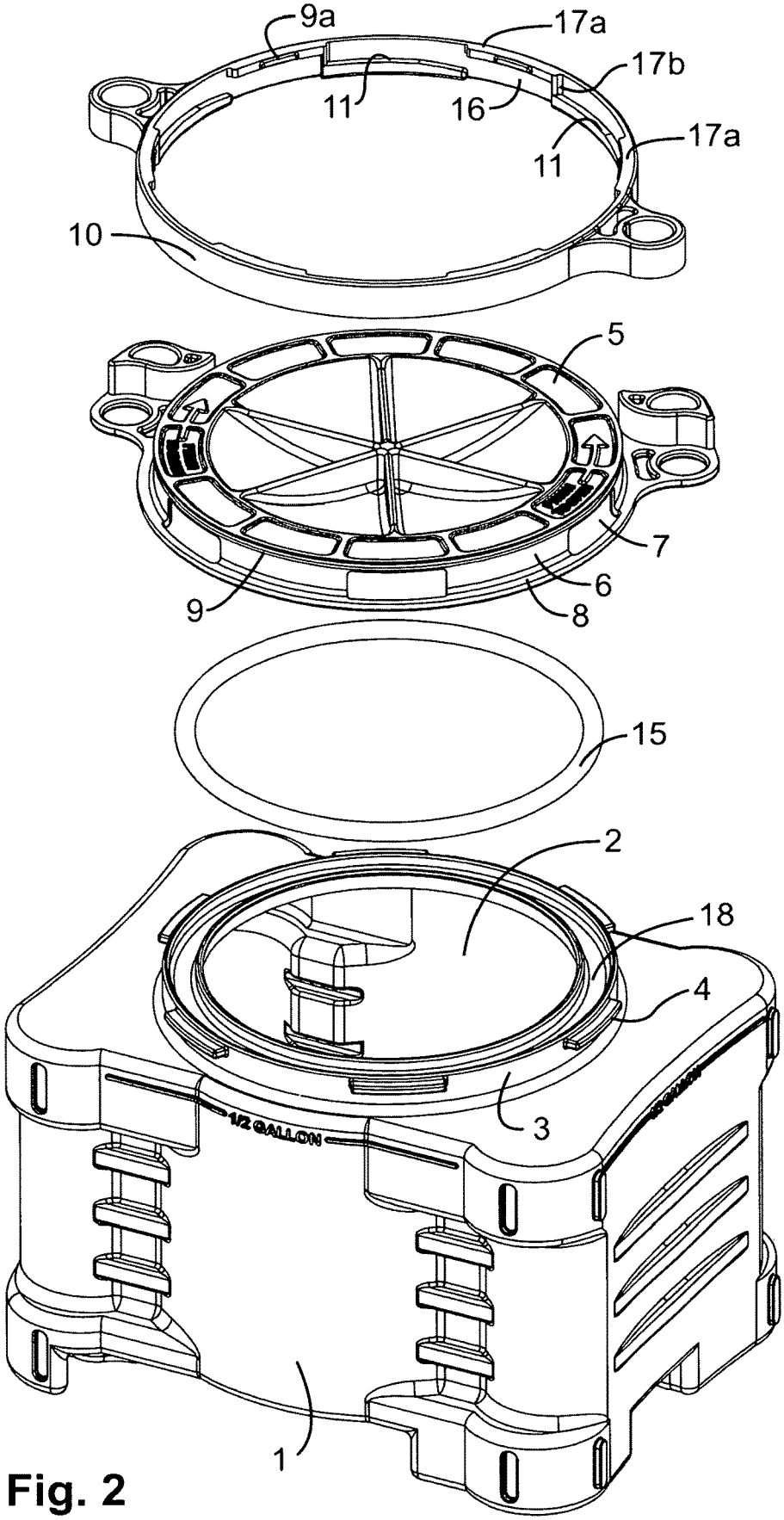
FIG. 2 is an exploded perspective view of the container of FIG. 1 showing a large transmural aperture defined by a pin-bearing shoulder that extends from the container's upper surface together with the components of a closure for manually opening and resealing the aperture without the use of tools.

Referring to the embodiment of the invention shown in the perspective view of FIG. 1 and the exploded perspective view of FIG. 2, the container includes two basic components, a resealable enclosure 1 and a closure consisting of a lid 5 and a rotatable collar 10. As shown in FIGS. 1 through 10, the enclosure 1 is scaled to a volume of slightly more than one-half gallon, 116 cubic inches or 1.9 liters. As further shown in the exploded view of FIG. 2, access to the enclosure 1 is through a large transmural aperture 2 that is spatially defined by an annular shoulder 3 that extends from the upper surface of the enclosure 1. Six spaced pins 4 extend radially from the outer surface of the shoulder 3. FIG. 6C provides a detailed view of the aperture 2 defined by the shoulder 3 with its radially extending pins 4, all in relation to the upper surface of enclosure 1.

As shown generally in FIG. 2 and in detail in FIGS. 6A and 6B, the lid 5 includes a downwardly extending tubular wall 6. Extending radially outward from the bottom of tubular wall 6 is a circumferential flange 8. Six spaced slots 7 extend through the wall 6 and into and through an inner portion the flange 8. As shown in the detail of FIG. 6E, the slots 7 align with and correspond geometrically to the pins 4 so that when the lid 5 is placed over the shoulder 3, the pins 4 engage and pass into the corresponding slots 7. The circumferential dimension of the slots 7 and the pins 4 are closely matched to allow the lid 5 to slide axially down over the shoulder 3 while preventing any substantial rotation between the lid 5 and the enclosure 1 when the lid 5 is fully engaged.

Figure 6D:
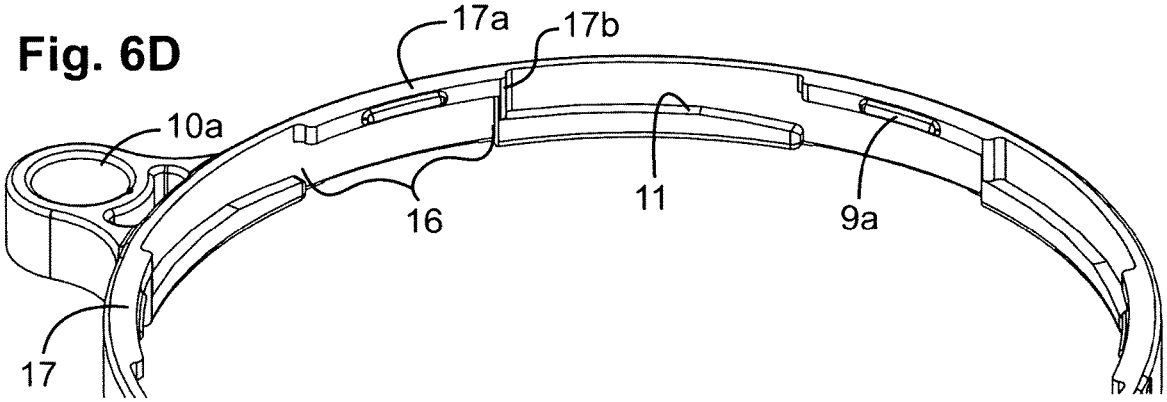
Figure 6E:
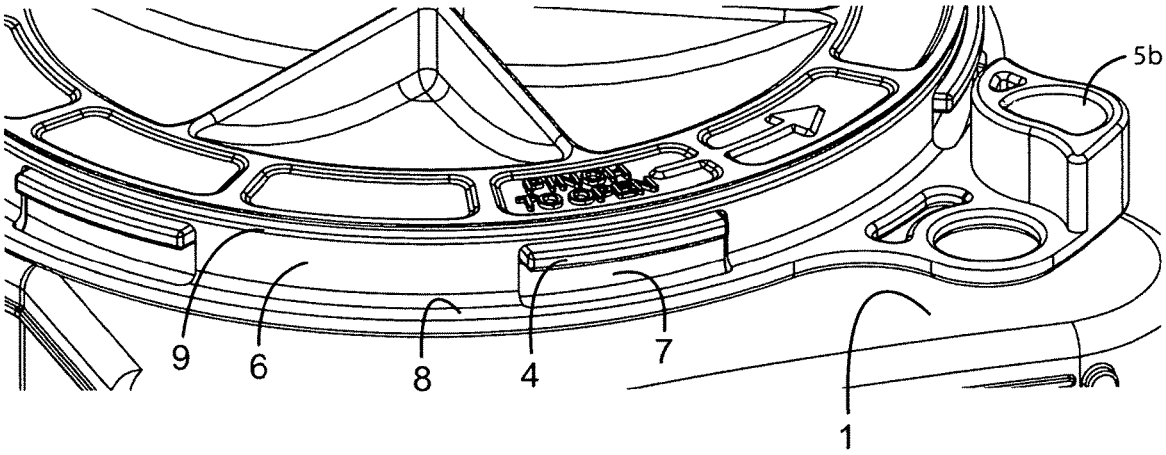

Referring generally to FIG. 2 and to the detailed perspective view of FIG. 6D, the collar 10 includes six tapered surfaces 11 that extend radially inward from the inner surface of collar 10. Between the tapered surfaces 11 are segments 16 of the collar 10 having reduced thickness to accommodate the pins 4 when the collar 10 is assembled over the lid 5 and this assembly is placed over the shoulder 3. The segments 16 extend partially into the inner surface of the collar 10 and terminate in full-thickness horizontal portions 17*a* of the L-shaped stops 17. As will be further described in relation to FIGS. 3A, 3B and 3C, the tapered surfaces 11 are spaced to correspond spatially to pins 4 and slots 7.

As shown in FIG. 2 and in greater detail in FIG. 6C, a deformable gasket 15 is located in a circular seat 18 at the upper end of the shoulder 3. When the lid 5 is in place over the shoulder 3, the gasket 15 is engaged between the seat 18 and the lower or inner surface of the lid 5. When the gasket 15 is uniformly compressed between lid 5 and seat 18, the gasket functions to seal the transmural aperture 2 and thus the enclosure 1.

As seen in FIGS. 2, 6A and 6B, the lid 5 includes an exterior circumferential grove 9 around the upper portion of wall 6 and above the slots 7. Referring to FIGS. 2 and 6D, each of the horizontal portions 17*a* of the stops 17 include snap ridges 9*a* that extend radially inward from the inner surface of 17*a*. When the collar 10 is placed over and around the lid 5, the lower surface of the collar 10 approaches full contact with the upper surface of the flange 8. At this point, the snap ridges 9*a* come in contact with the outer edge of the lid 5 at points just above the circumferential grove 9. When the collar 10 is forced asymmetrically down and around the lid 5, the collar 10 distorts slightly and the ridges 9*a* to snap into the grove 9. During normal use, this snap engagement serves to retain the collar 10 in axial relation to the lid 5 but allows the collar 10 rotate relative to lid 5. When the collar 10 and lid 5 are snapped together there is sufficient clearance provided to allow the snap ridges 9*a* to slide circumferentially in groove 9, allowing the collar 10 rotate freely in relation to the lid 5.

Figure 3A:
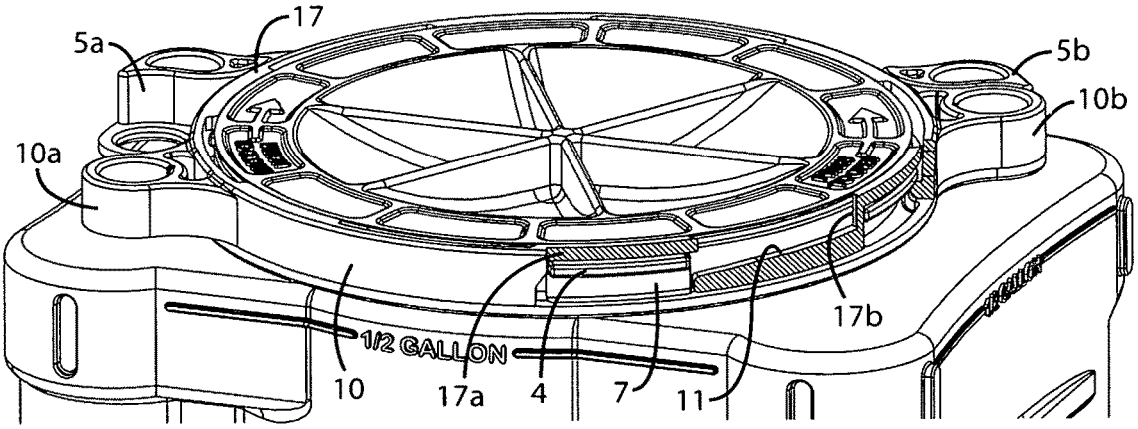
FIGS. 3A, 3B and 3C are perspective cutaway views showing the relative positions of the closure elements when the lid is in its fully open (FIG. 3A), intermediate (FIG. 3B) and fully closed (FIG. 3C) positions.
Figure 3B:
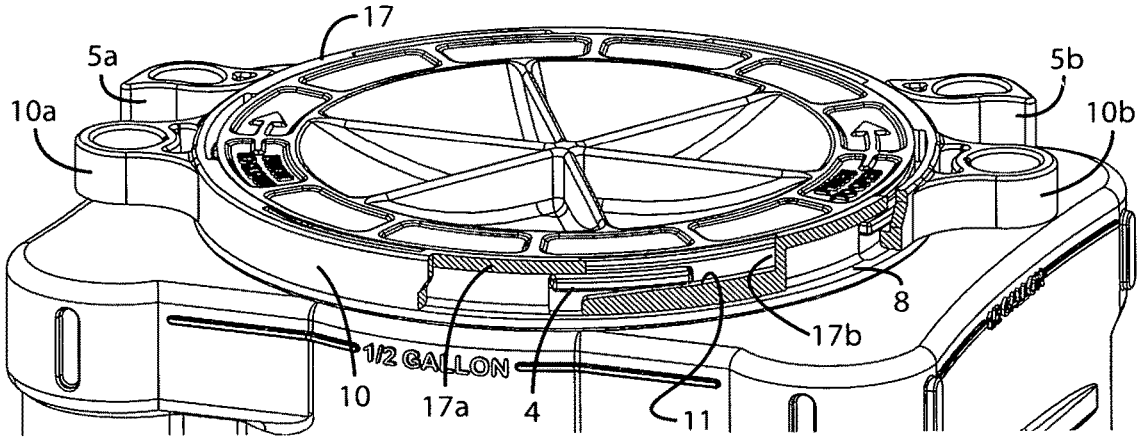
Figure 3C:
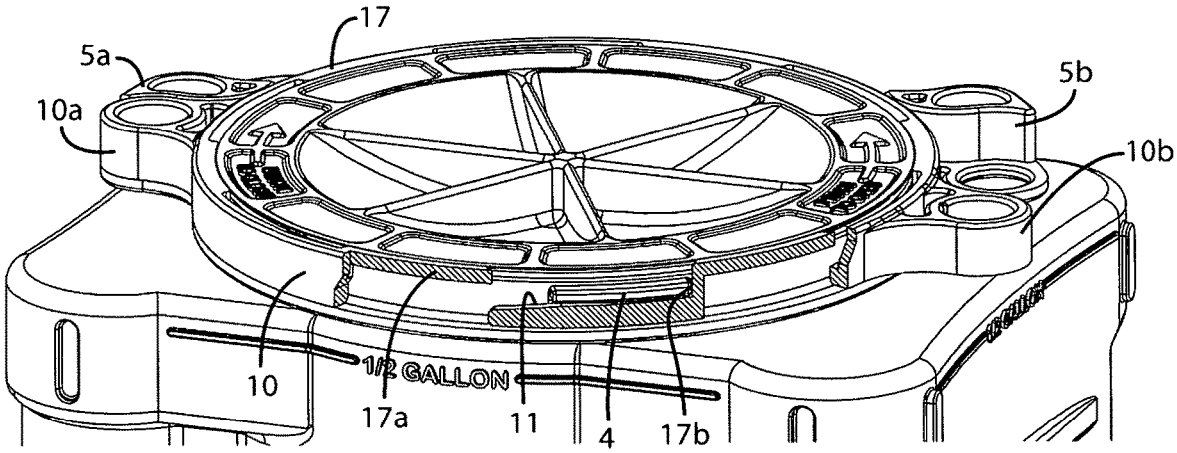

FIGS. 3A, 3B and 3C are cutaway perspective views showing the progression of one of the tapered surfaces 11 in relation to its corresponding pin 4 as the collar 10 is rotated from the fully open position (FIG. 3A) through an intermediate position (FIG. 3B) to a fully closed position (FIG. 3C). In these related figures that portion of the collar 10 that is radially outside the tapered surface 11 has been cutaway, leaving only the crosshatched sections of tapered surface 11 and the functionally related portions of stops 17*a* and 17*b*.

In FIG. 3A, the lid 5 and assembled collar 10 are in place over the shoulder 3. The lid 5 cannot rotate in relation to the shoulder 3 (or the enclosure 1) because the pins 4 are within and restrained by slots 7. As shown in FIG. 3A, the collar 10 and the tapered surface 11 are in their most counterclockwise or open position, the pin 4 is fully engaged in its corresponding slot 7 and is adjacent to the horizontal stop 17*a*. While the lid 5 cannot rotate in relation to the shoulder 3, the collar 10 can be rotated in a clockwise direction from its fully open position shown in FIG. 3A to its fully closed position shown in FIG. 3C.

In FIG. 3B the collar 10 has rotated clockwise about 15 degrees to an intermediate position that is about half way between the fully open and fully closed positions. As the collar 10 rotates around the wall 6 on lid 5, it rides on the top surface of the flange 8. The tapered surface 11 is defined by at least one angle relative to the top surface of flange 8. As the tapered surface 11 is advanced under the pin 4, the pin 4 is forced progressively away from the flange 8, resulting in the inside surface of the lid 5 being drawn down and into closer proximity to seat 18 and the gasket 15 (see FIGS. 2 and 6C). The extent to which the tapered surface 11 forces separation between the pin 4 and the flange 8 is directly related to the amount gasket 15 is compressed between the inner surface of lid 5 and the seat 18. Viewed differently, if a container designer seeks to achieve a 20 percent compression of gasket 15 to obtain an appropriate seal of the enclosure 1, then the angle of the tapered surface 11 will be calculated to assure a corresponding displacement between the pins 4 and the flange 8 when the collar 10 has been rotated to its fully closed position shown in FIG. 3C. As shown in FIG. 6D, the tapered surface 11 can include two segments having slightly different angles, with an initial segment having a steeper angle that draws the inner surface of lid 5 into initial contact with the gasket 15 and a final segment having a flatter angle that produces the desired compression of the gasket 15. FIG. 3C shows the collar 10 rotated to its most clockwise or fully closed position with the pin 4 abutting the vertical portion of the stop 17*b*. In this fully closed position, the lid 5 and collar 10 assembly is securely locked onto the shoulder 3 and the gasket 15 is optimally compressed between the inner surface of lid 5 and the seat 18.

Figure 4A:
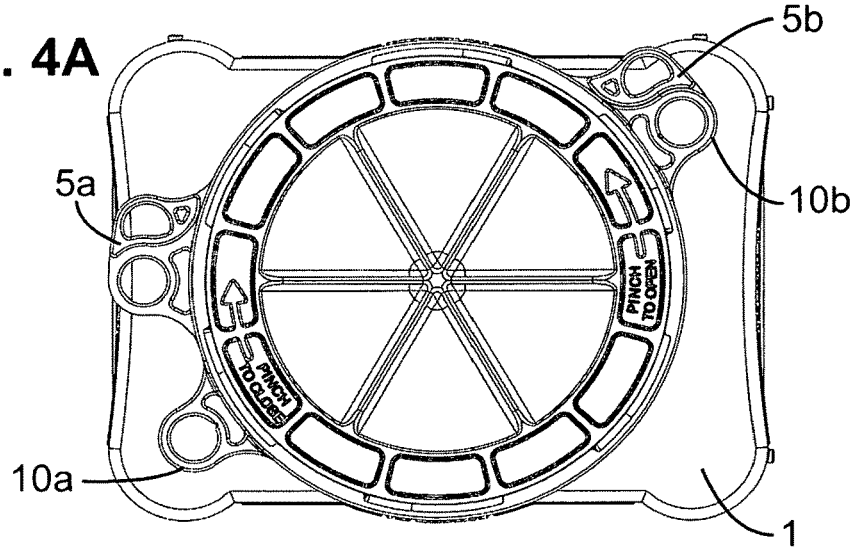
FIGS. 4A, 4B and 4C are top plan views of the closure shown in the respective views of FIGS. 3A, 3B and 3C and more clearly showing the relative positions of the two sets of paired protrusions extending from the lid and collar when the closure is in the fully open (FIG. 4A), intermediate (FIG. 4B) and fully closed (FIG. 4C) positions.
Figure 4B:
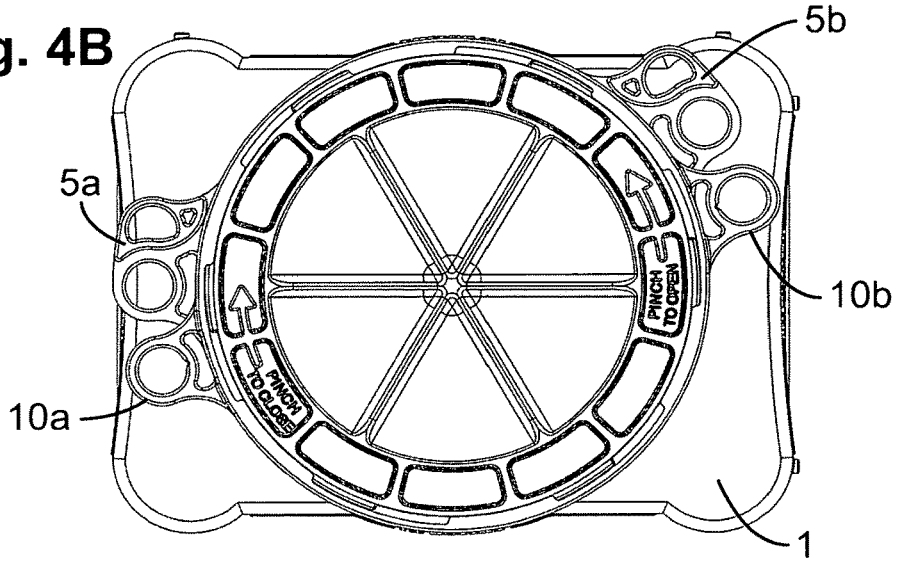
Figure 4C:
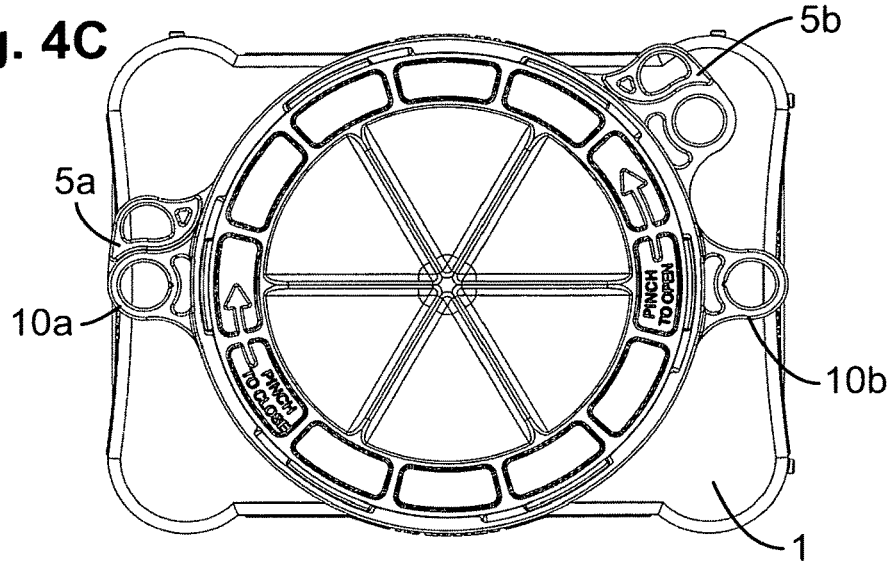

FIGS. 4A, 4B and 4C are plan views of the lid 5 and collar 10 assembly in place over the shoulder 3 on the upper surface of enclosure 1. The rotational positions of the collar 10 shown in FIGS. 4A, 4B and 4C correspond to the same positions shown in the cutaway perspective views of FIGS. 3A, 3B and 3C respectively. Rotation of the collar 10 in relation to the fixed lid 5 and enclosure 1 is accomplished by the user exerting manual pinch force between two sets of paired protrusions, 5*a*-10*a* (to close) and 5*b*-10*b* (to open).

As shown in FIGS. 4A, 4B and 4C, each set of protrusion includes one protrusion 5*a* (or 5*b*) secured to the lid 5 and another protrusion 10*a* (or 10*b*) secured to the collar 10. When a first of these protrusion sets, 5*a*-10*a*, is pinched together, the collar 10 is rotated clockwise to advance the tapered surfaces 11 between the pins 4 and the flange 8, resulting in the collar 10 advancing from the fully open position of FIGS. 3A and 4A to the fully closed position of FIGS. 3C and 4C. As the first set of protrusions 5*a*-10*a* are pinched together, the second pair of protrusions 5*b*-10*b* become proportionately more separated until they are at their maximum point of separation with the collar 10 in its fully closed position shown in FIGS. 3C and 4C. When the user then exerts pinching force between the second pair of protrusions 5*b*-10*b*, the collar 10 rotates in a counterclockwise direction and these protrusions move into closer proximity as the tapered surfaces 11 are withdrawn from between the pins 4 and the flange 8 until the protrusions 5*b*-10*b* are contiguous and the closure (5/10) is in its fully open position shown in FIGS. 3A and 4A.

Figure 5A:
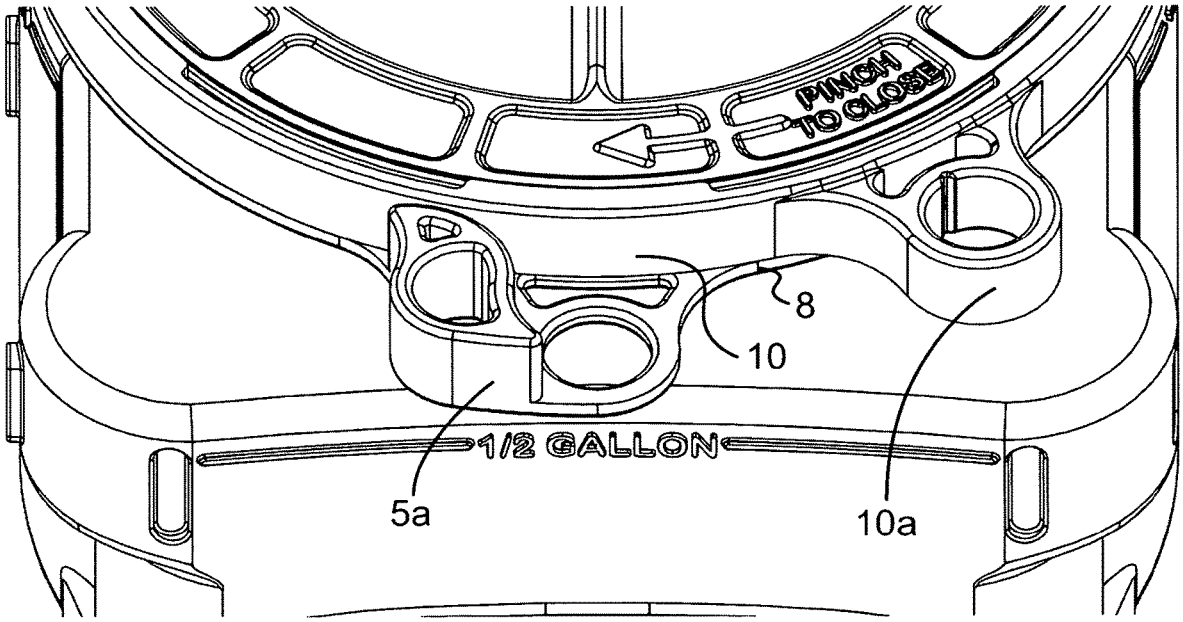
FIG. 5A is a detailed perspective view of one set of paired protrusions in the same fully open position shown in FIGS. 3A and 4A.
Figure 5B:
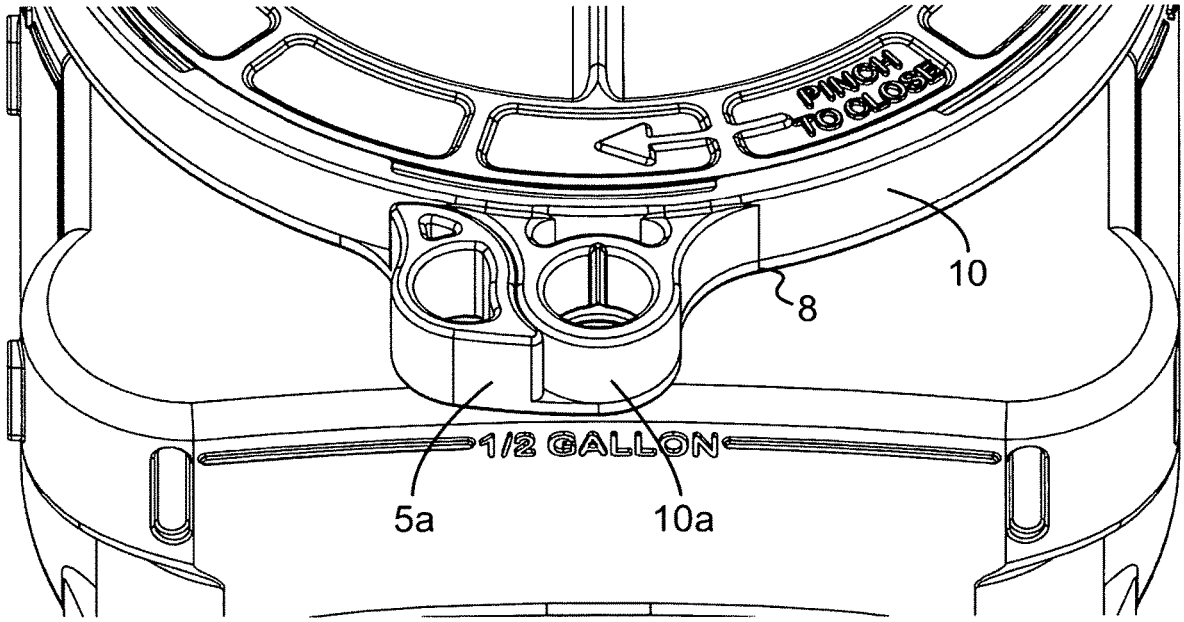
FIG. 5B is a detailed view of the same set of paired protrusions in the fully closed position shown in FIGS. 3C and 4C.

FIGS. 5A and 5B are detailed perspective views of the paired protrusions 5*a* and 10*a*. FIG. 5A shows the position of these protrusions when they are in the fully open position while FIG. 5B shows them in the fully closed position. FIGS. 5A, 6A and 6E show how the protrusions 5*a* and 5*b* are secured to the lid 5 as integral extensions from the flange 8. FIGS. 5A and 6D show generally how the protrusions 10*a* and 10*b* are molded extensions of the collar 10. In this embodiment of the invention, each of the protrusions 5*a* and 5*b* includes a tall section that corresponds to the height of the collar 10 and a short section that corresponds to the thickness of the flange 8. See FIGS. 5A and 6E. While the protrusions 5*a* and 5*b* are shown as connected to the flange 8 of lid 5, functionally equivalent protrusions could be attached to enclosure 1 because, as shown in FIG. 6E, the lid 5 cannot rotate relative to the enclosure 1, because pins 4 on shoulder 3 are rotationally restrained within the slots 7 in wall 6 of lid 5.

The embodiment of the invention shown in FIGS. 1-9 includes two sets of paired protrusions, 5*a*-10*a* and 5*b*-10*b*. Exerting single-handed manual forces between the first set of protrusions produces clockwise rotation between the collar 10 and both the lid 5 and enclosure 1; similarly, manual forces between the second set of protrusions produces an equivalent counterclockwise rotation. Containers with larger apertures and those requiring a higher level of closure or sealing force may require the concurrent exertion of two-handed manual forces. This can be accommodated by providing four sets of paired protrusions (a) two sets corresponding to 5*a*-10*a* being separated by approximately 180 and (b) two sets corresponding to 5*b*-10*b* also being separated by approximately 180. In this configuration, the user can apply separate bilateral pinch forces to the diametrically located protrusion sets 5*a*-10*a* to cause clockwise rotation with up to twice force available from single hand operation. Corresponding bilateral pinch forces separately applied across the two sets of paired protrusions 5*b*-10*b* produces counterclockwise rotation with increased manual force.

In a simpler embodiment of the invention, there can be a single protrusion extending from the collar 10 with two protrusions extending from the lid 5 (or enclosure 1) on either side of and spaced apart from the single collar protrusion. Pinch forces between the single collar protrusion and one of the two lid protrusions, produces clockwise rotation of the collar relative to the lid. Similarly, pinch forces between the single collar protrusion and the second lid protrusion produces counterclockwise rotation. The same result can be achieved by providing first and second protrusions spaced apart on the collar together with a single protrusion extending from the lid 5 (or enclosure 1) and located between the first and second collar protrusions. Pinch forces between the first collar protrusion and the single lid protrusion produces clockwise rotation while pinch forces between the second collar protrusion and the single lid protrusion causes counterclockwise rotation.

Figure 7A:
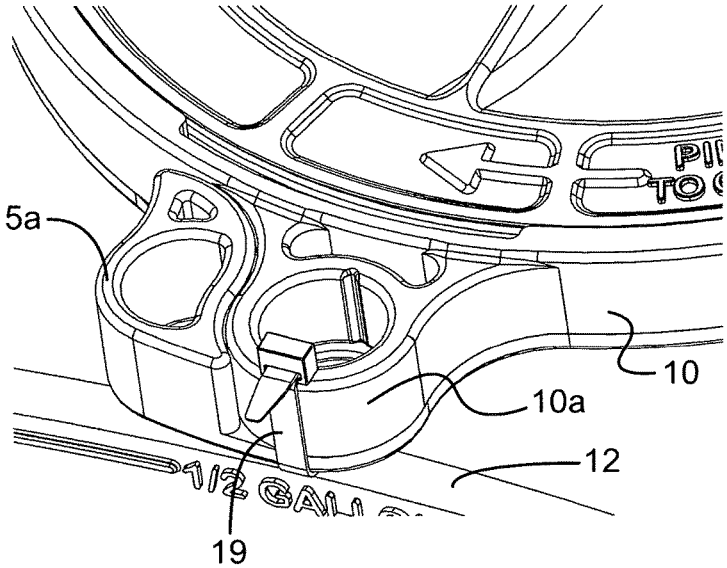
FIGS. 7A and 7B are detailed perspective views of the closure in its fully closed position with a zip tie secured through the overlapping paired protrusions to serve as a tamper proof element.
Figure 7B:
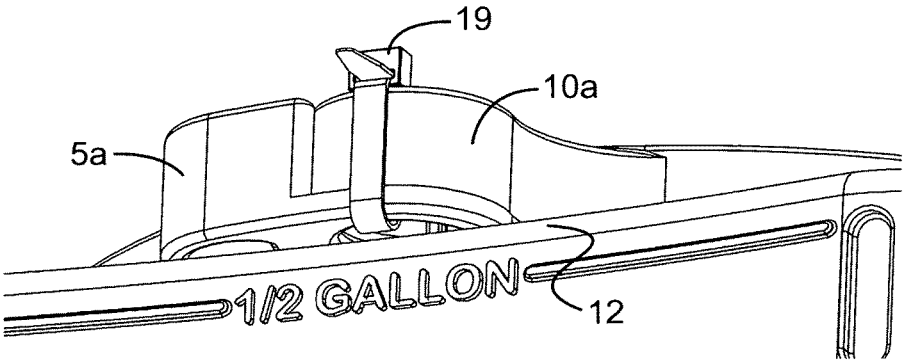
Figure 7C:
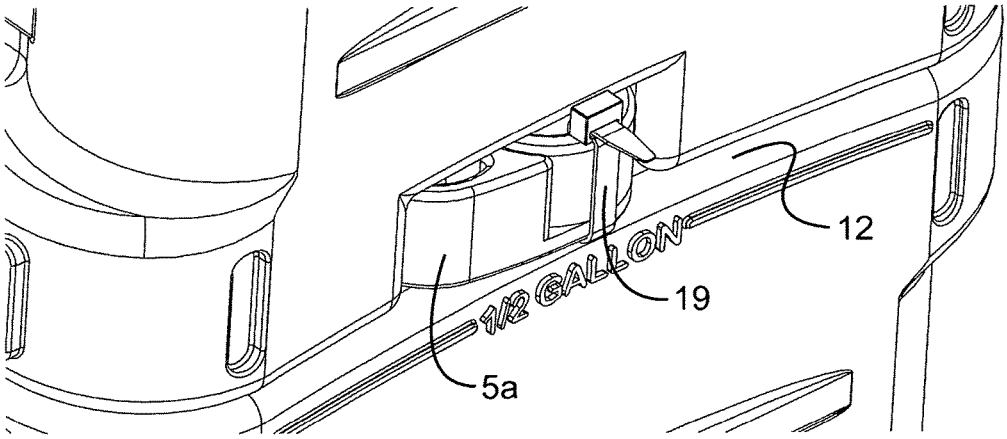
FIG. 7C is a detailed view showing the tamper proof element in relation to an adjacent stacked container.

Referring to FIGS. 5A and 5B it is seen that as the collar 10 is rotated into the fully closed position (clockwise), the protrusion 10*a* slides over the short section of protrusion 5*a* and the central holes through these paired protrusions come into vertical alignment as shown in FIGS. 3C, 4C and 5B. This alignment in the fully closed position provides a clear visual indication that the container is fully closed and/or properly sealed. As shown in FIG. 7A this alignment also provides an opportunity to incorporate a tamper proof feature like the zip tie 19 secured through the two aligned holes in protrusions 5*a* and 10*a*. FIG. 7B shows how the radiused edge 12 along the top of the enclosure 1 provides a gap through which the zip tie 19 can pass. FIG. 7C shows the zip tie 19 in place when two containers of the same design are stacked on top of one another as described below in relation to FIGS. 9A and 96.

Figure 8A:
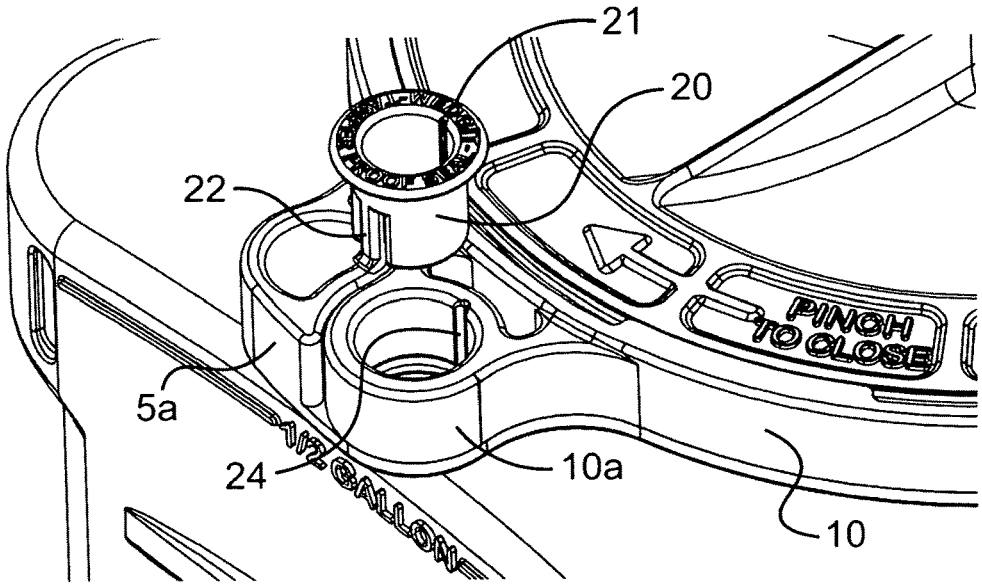
FIGS. 8A, 8B and 8C are detailed perspective views of one set of paired protrusions when the lid is in the fully closed position in relation to an alternative form of tamper proof element suitable for use in the delivery and storage of critical or high value contents.
Figure 8B:
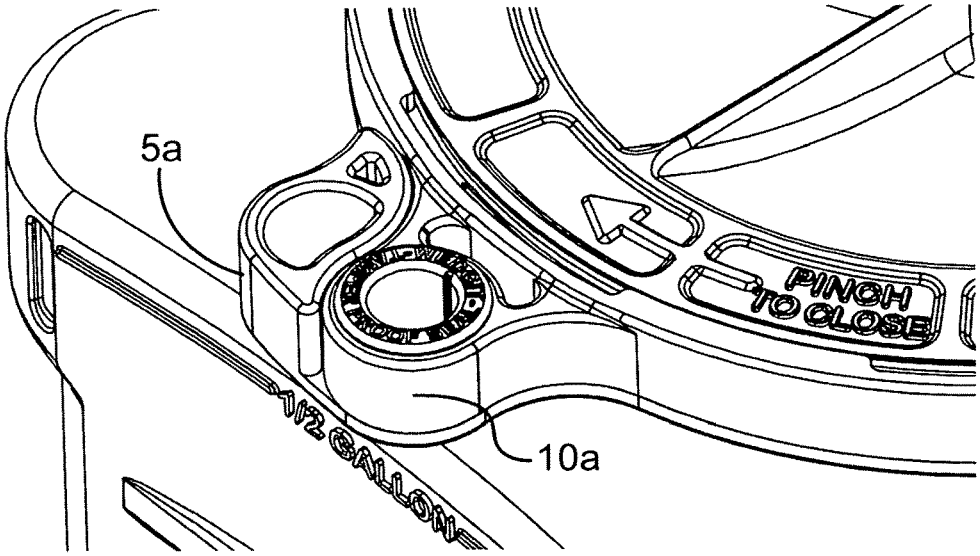
Figure 8C:
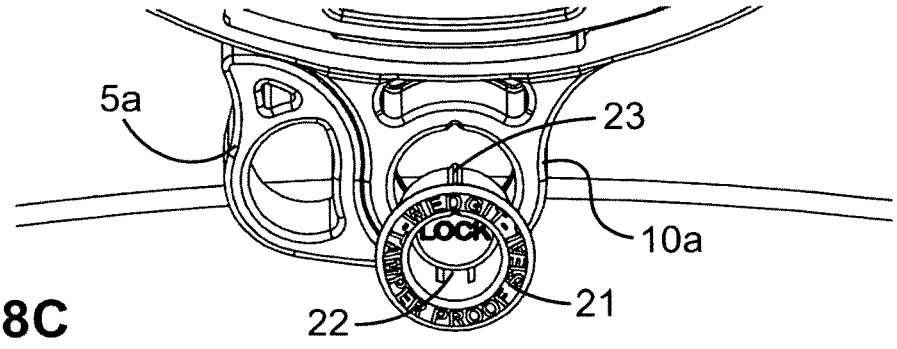

FIGS. 8A, 8B and 8C show the installation and features of an alternative form of tamper proof element that can be incorporated into the aligned holes through the protrusions 5*a* and 10*a* when they are in their fully closed positions. FIG. 8A shows a hollow plug 20 that includes a top portion 21 that is larger than the diameter of the hole in the protrusion 10*a*. The hollow plug 20 also includes a displaceable latch 22 having a beveled lower edge that causes it to flex and retract radially inward when the plug 20 is inserted into the hole in protrusion 10*a*. When the plug 20 is fully inserted through both of the holes in protrusions 5*a* and 10*a*, the bottom of the latch 22 snaps outward, just below the bottom surface of the protrusion 5*a*, thereby securing the plug within the aligned holes. The plug 20 also includes an alignment rib 23 (see FIG. 8C) that slides in alignment a recess 24 when the plug 20 is installed in the aligned holes through protrusions 5*a* and 10*a*. The rib 23 and recess 24 prevent the plug from rotating and assure that the bottom of the displaceable latch is properly oriented for clear visibility and easy access for removal. In the preferred embodiment, the displaceable latch 22 will include a preformed horizontal fracture line that will result in the latch 22 snapping off when the plug 20 is removed.

Figure 9A:
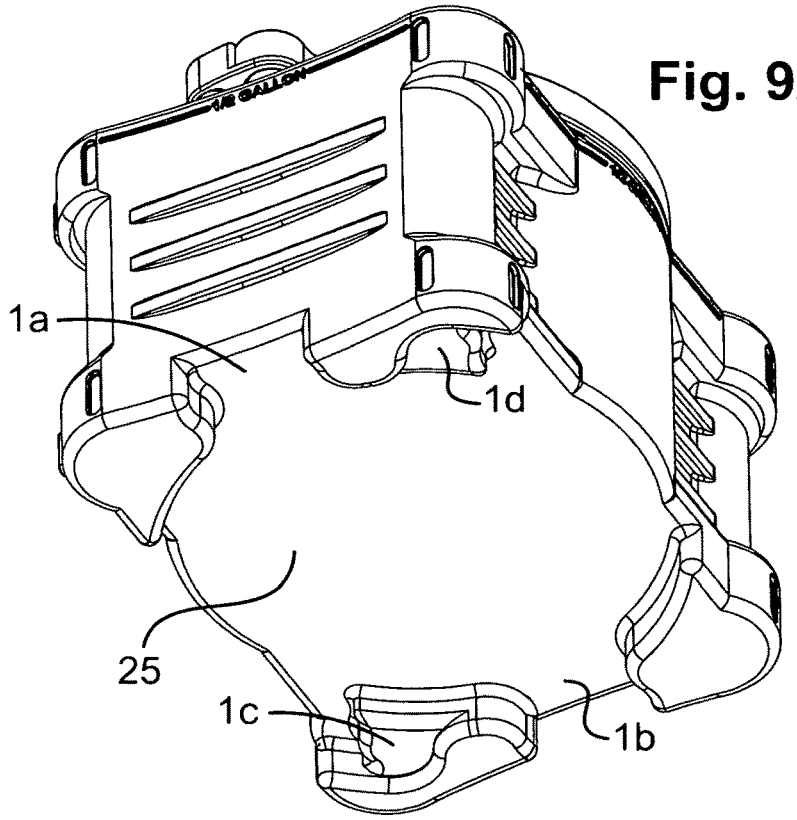
FIGS. 9A and 9B are perspective views showing the complementary geometric relationship between the recessed area on the bottom of a first (upper) container (FIG. 9A) and the mating configuration of a second (lower) container on which the first container is stacked.
Figure 9B:
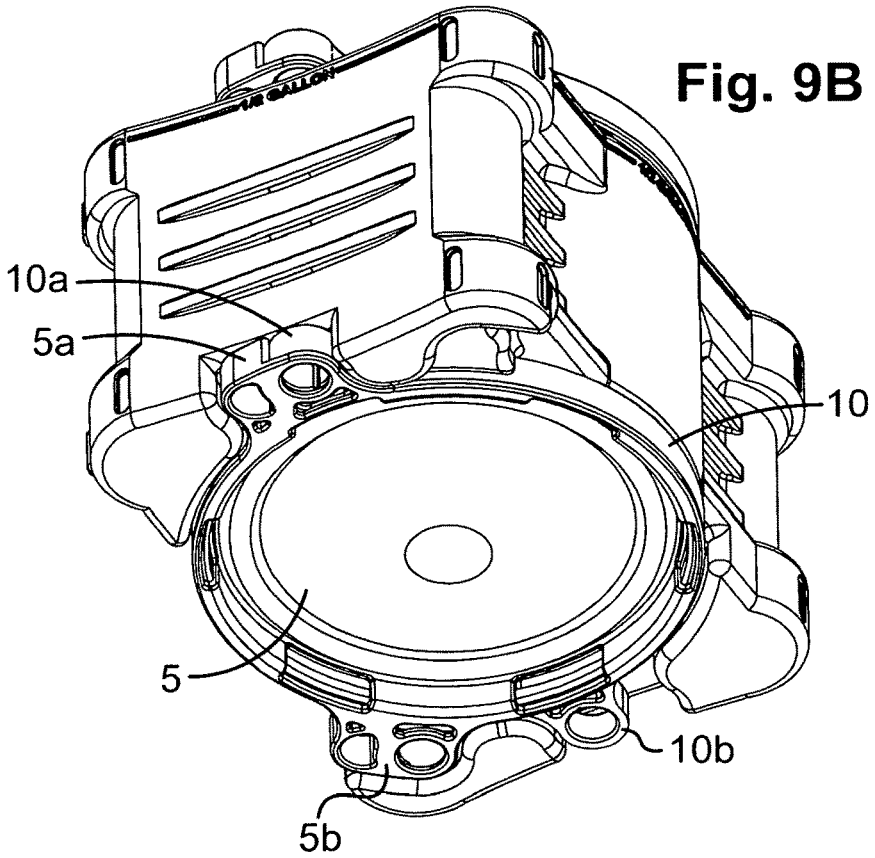
Figure 11:
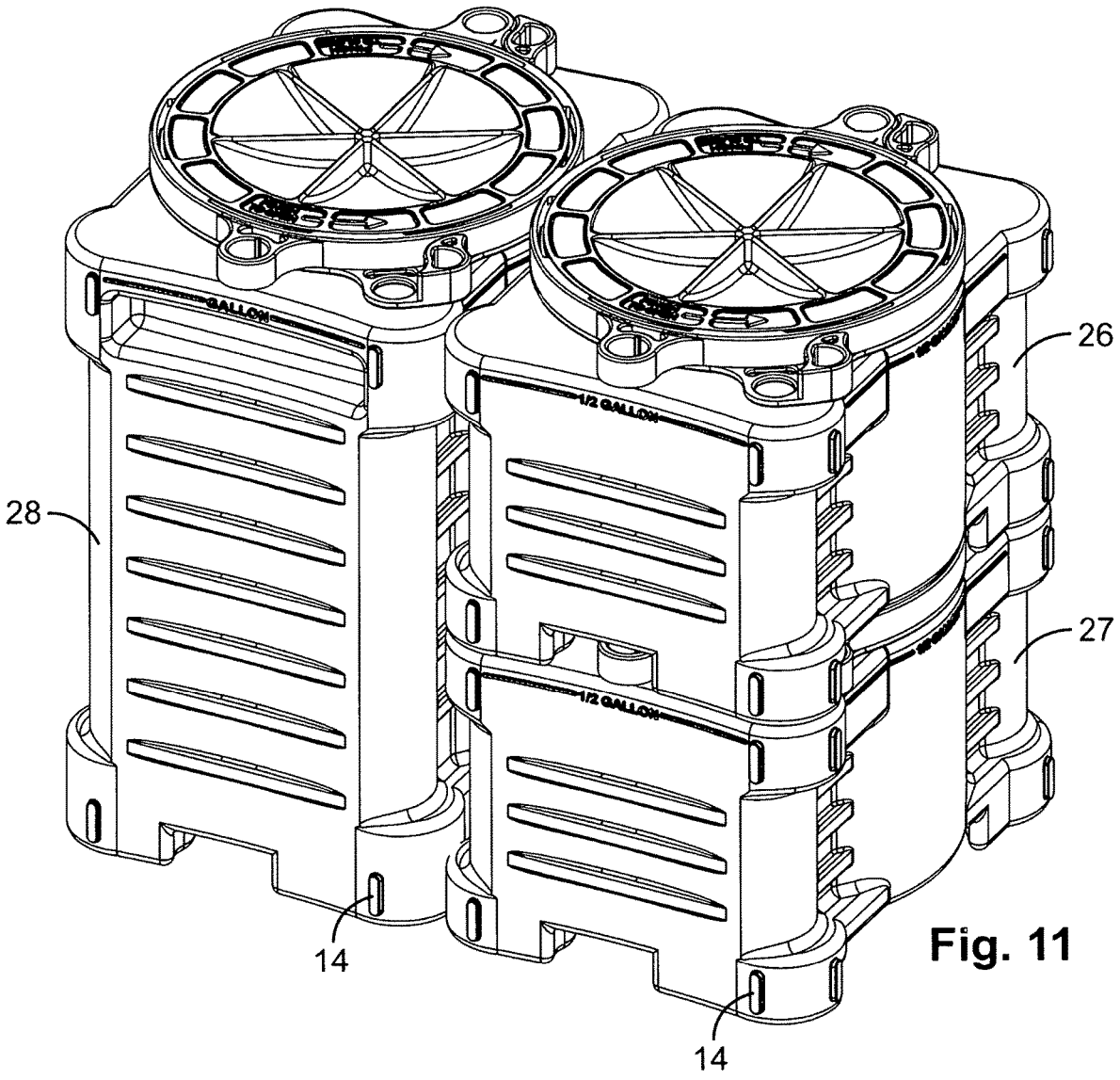
FIG. 11 is a perspective view showing an assembly of two stacked, half-gallon containers of the type described in relation to FIGS. 1 through 6 with a horizontally engaged one-gallon container of the same design having complementary pairs of ridges and recesses on opposing sides (FIG. 10C).

FIGS. 9A and 9B show the complementary geometric relationship between the recessed bottom 25 of the enclosure 1 (FIG. 9A) and the configuration of the lid 5 and collar 10 assembly when in their fully closed position on the top of a vertically adjacent container (FIG. 9B and FIG. 11). The gaps 1*a* and 1*b* on the bottom of the enclosure 1 (FIG. 9A) are both configured to receive the overlapping structure of protrusions 5*a* and 10*a* when in their fully closed positions (as shown in FIG. 5B). Similarly, the recessed areas 1*c* and 1*d* are both configured to receive protrusion 5*b* when in the lid and collar are in the fully closed position.

In FIG. 9B the closed protrusions 5*a*-10*a* are received in gap 1*a*, while the fully separated protrusions 5*b* and 10*b* are received, respectively, in the complementary gaps 1*c* and 1*b*. If the lid 5 and collar 10 were rotated 180 degrees from the position shown in FIG. 9A, the gaps 1*a* through 1*d* would provide an equally complementary geometry to receive the protrusions in their fully closed positions. In this case the contiguous and overlapping protrusions 5*a* and 10*a* would be received in gap 1*b* and the separated protrusion 5*b* would be received in gap 1*d*. Stated differently, the recessed bottom 25 of enclosure 1 is symmetrically complementary in relation to the geometry of the lid 5 and collar 10 when they are in their fully closed positions. The shape and limited width of gaps 1*a* and 1*b* preclude the normal stacking of containers when the lid 5 and the collar 10 are not in their fully closed positions.

As shown in FIG. 1, one of the short sides of the enclosure 1 includes a pattern of four short ribs 14. The opposite short side of enclosure 1 includes a mating pattern of four short recesses. Similarly, one of the long sides of the enclosure 1 includes a pattern of four short recesses 13 and the opposite long side of enclosure 1 includes a mating pattern of four short ribs 14. When two containers having this design are aligned side-by-side or end-to-end, the pattern of complementary recesses 13 and ribs 14 engage and restrict lateral motion between the two contiguous containers.

Figure 10A:
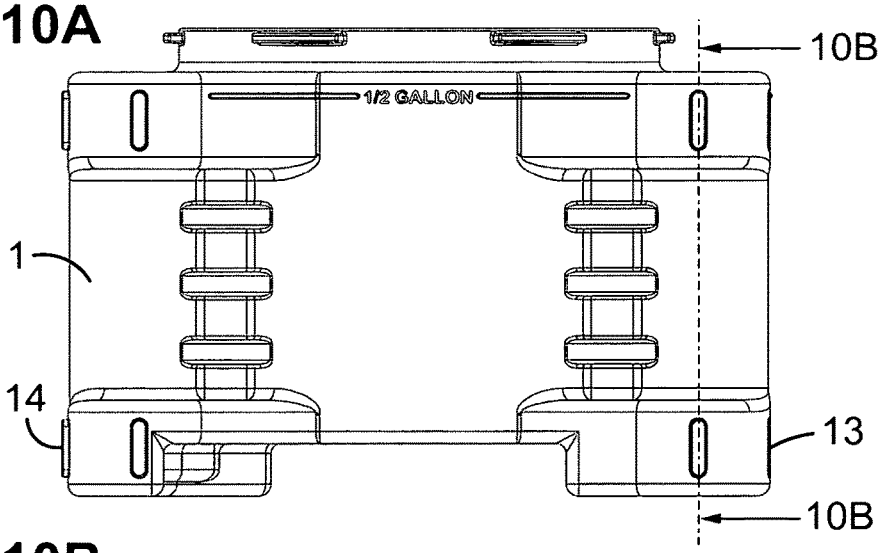
FIGS. 10A, 10B and 10C are plan views of a horizontally engaged pair of enclosures (without closures).
Figure 10B:
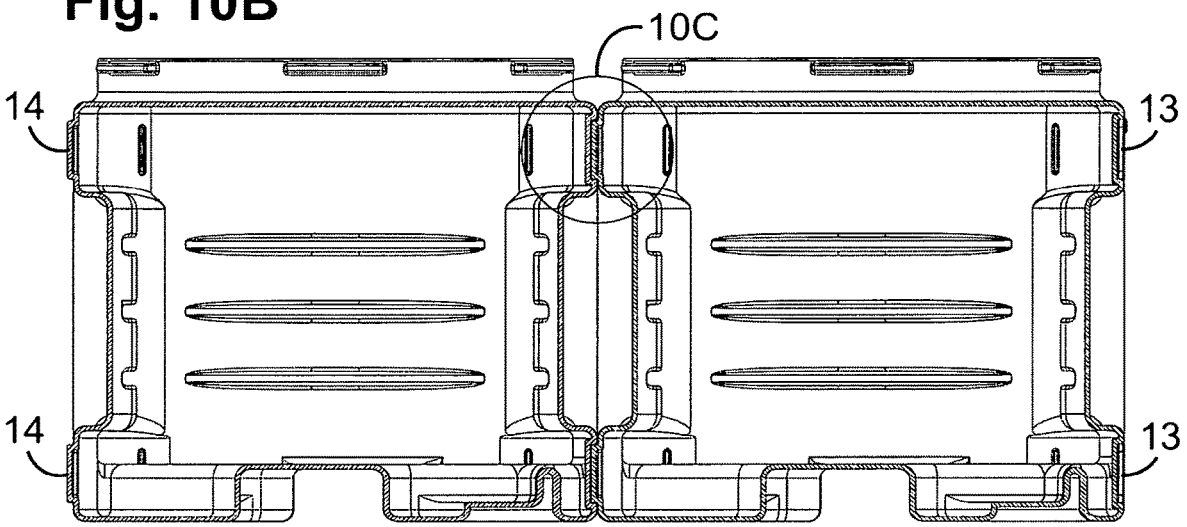
Figure 10C:
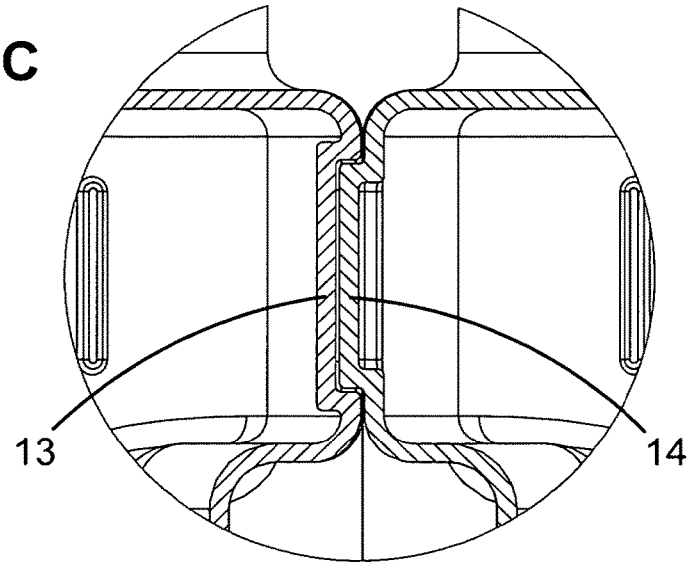

FIG. 10A is a side plan view of two enclosures 1 aligned side-by-side with one container behind the other. FIG. 10B is a sectional view through both of the aligned containers taken along the section line 10B-10B in FIG. 10A and through the centers of the complementary pairs of ribs 14 and recesses 13 on opposite sides of the two enclosures 1. FIG. 10C is an enlargement of the circled area in FIG. 10B. This detail shows a cross section of one recess 13 on the left container mated with its corresponding rib 14 on the right container as shown in FIG. 10B. The complementary relation between the recesses 13 and ribs 14 on opposite sides of these adjacent containers limits their lateral movement when assembled together for packaging, shipping, display or storage.

FIG. 11 shows an assembly of two half-gallon containers 26 and 27 stacked together and laterally aligned with a single 1-gallon container 28 having width and length dimensions that are the same as those of the half-gallon containers 26 and 27. The height of the container 28 is equal to the combined height of the two stacked containers 26 and 27. Opposite sides of the container 28 include either four recesses 13 or four ribs 14 which are complementary to the mating elements near the top of the upper container 26 and those near the bottom of the lower container 27. This arrangement allows the creation, packaging, shipping and display of assemblies consisting of containers having different volumes.

Figure 12A:
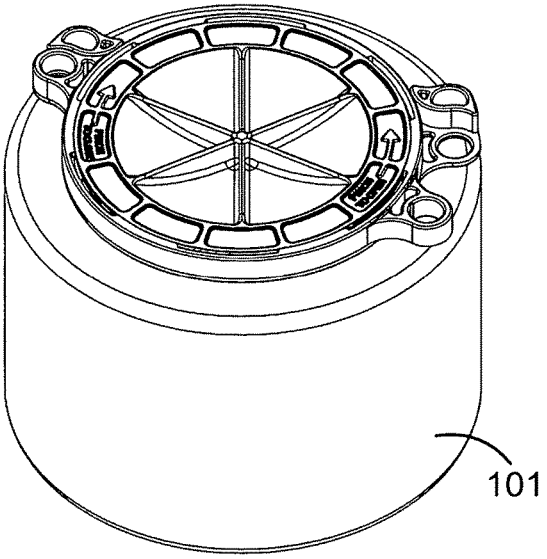
FIG. 12A, is a perspective view of a cylindrical enclosure incorporating the same lid, collar and pin-bearing shoulder arrangement described in relation to the container of FIGS. 1 through 9.
Figure 12C:
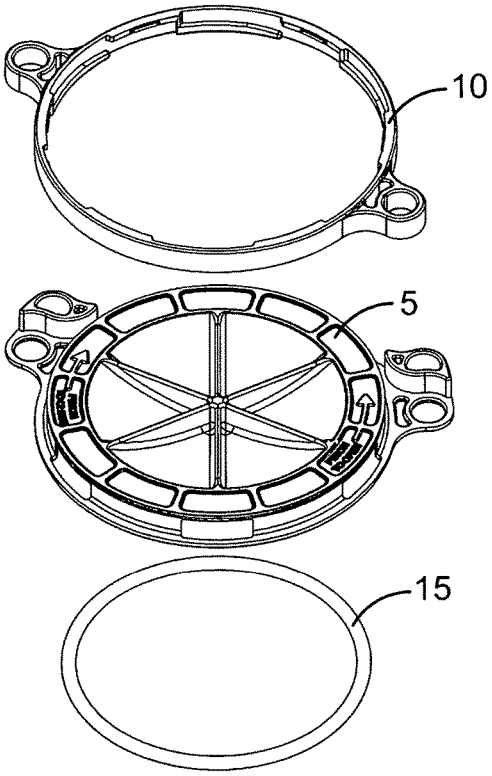
FIG. 12C is a bottom perspective view of the container in FIG. 12A showing an embossed pattern that is complementary to and receives the surface pattern on the lid of another such container and provides surface registration between similar stacked containers.
Figure 12C:
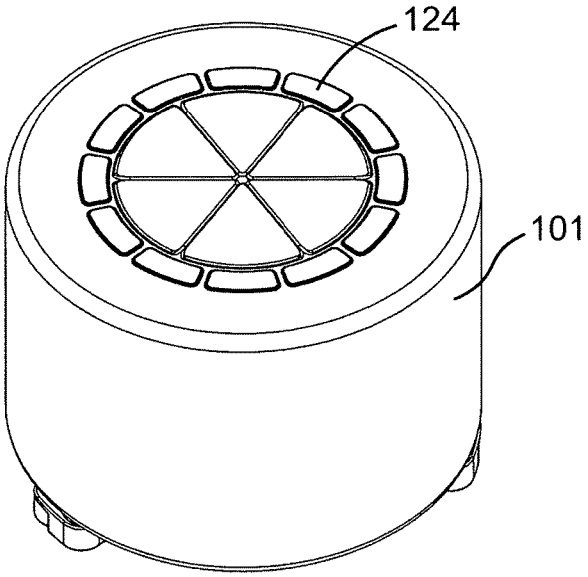
Figure 12B:
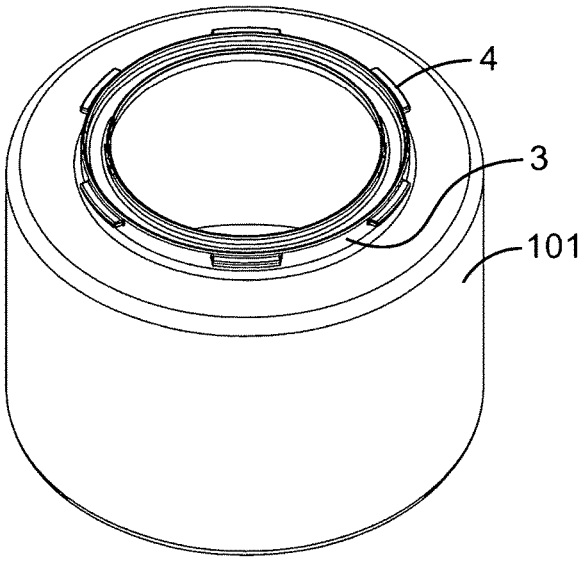
FIG. 12B is an exploded view showing the functional elements of the container of FIG. 12A.

FIGS. 12A, 12B and 12C show a simple cylindrical container 101 having a shoulder 3 with pins 4 that accept the same lid 5, collar 10 and gasket 15 described in relation to FIGS. 1 through 11. As shown in FIG. 12C, the bottom of enclosure 101 includes an embossed pattern 124 that is complementary to and receives the raised pattern of ridges on the upper surface of the lid 5. These complementary patterns allow for the stacking and vertical registration of cylindrical containers 101 having the same or different heights. Lateral registration of such containers can be achieved by providing complementary vertical ridges and recesses on diametrically opposite sides of the container as previously described in relation to the containers shown in FIGS. 10 and 11. While the enclosure 101 has the shape of a cylinder with a circular cross section, its cross section could be that of a square, rectangle, equilateral triangle, hexagon or octagon depending on the particular application and need for optimum packing of the containers for shipment. In each of these cross-sectional configurations, the vertical surfaces can incorporate complementary deformations that allow for side-by-side assembly of such containers with limited lateral movement between adjacent containers.

Figure 13A:
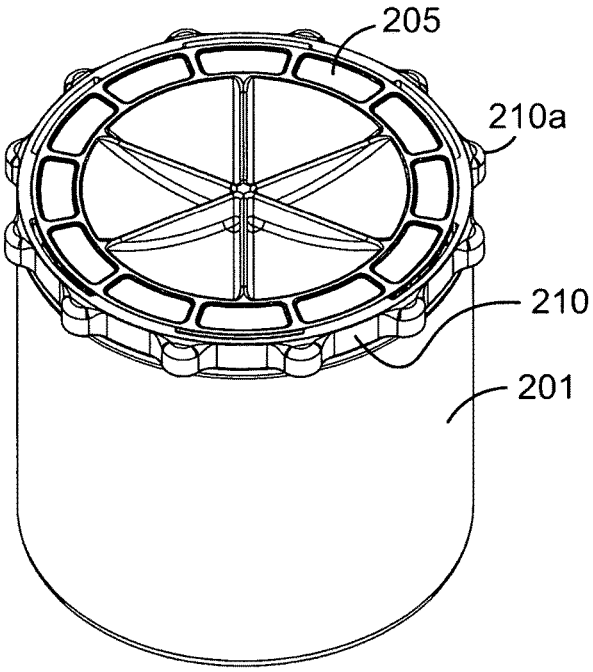
FIG. 13A, is a perspective view of a cylindrical enclosure with a diameter on the order of three inches or less and incorporating a smaller version of the closure described in relation to FIGS. 1 through 11 including a plurality of protrusions on the collar to accommodate manual rotation of the collar in relation to the lid.
Figure 13C:
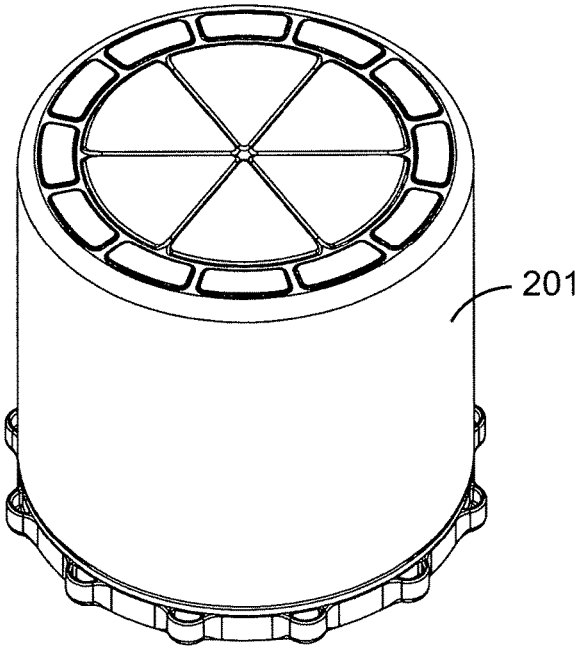
FIG. 13C is a bottom perspective view of the container in FIG. 13A showing an embossed pattern that is complementary to and receives the surface pattern on the lid of another such container and provides surface registration between similar stacked containers.
Figure 13B:
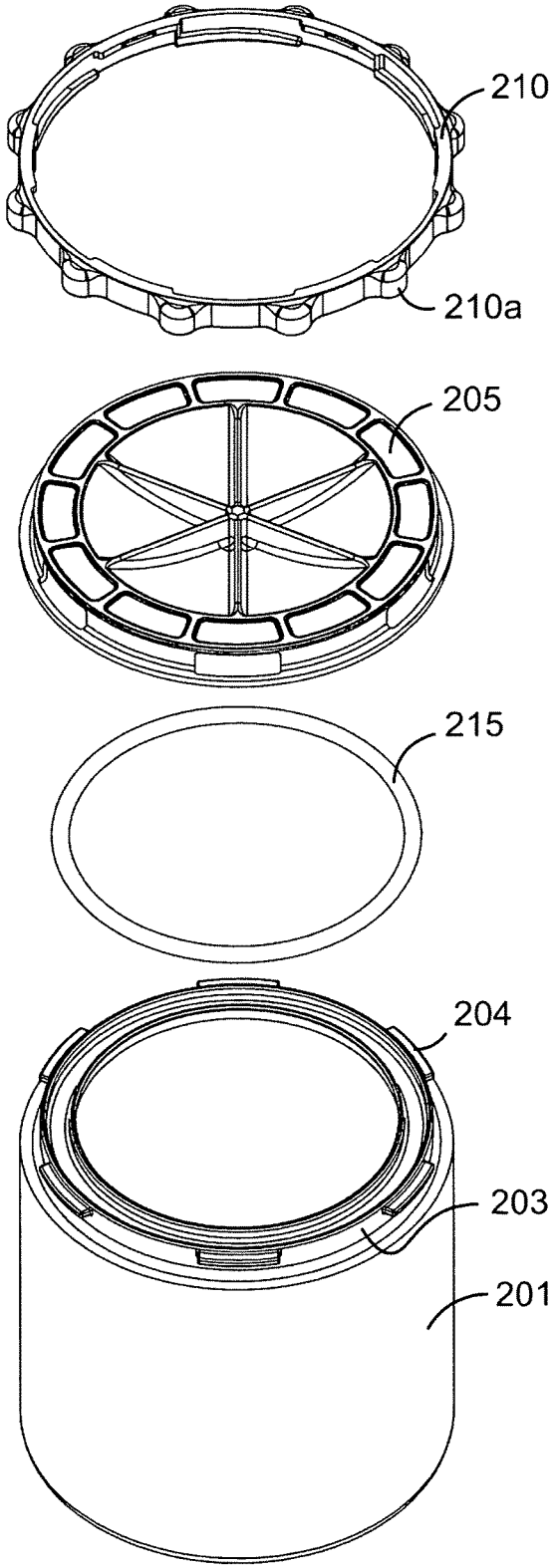
FIG. 13B is an exploded view showing the functional elements of the container of FIG. 13A.

FIGS. 13A, 13B and 13C show an alternative form of cylindrical container 201 having an outer diameter of about 3 to 3.5 inches (or less) with an upper shoulder 203 having pins 204 and a lid 205 assembled with a collar 210 that represent scaled down versions of the shoulder 3, pins 4, lid 5 and collar 10 described in relation to FIGS. 1 through 12. The collar 210 includes a plurality of protrusion 210*a* (12 are shown) for transferring manually applied rotational forces between the collar 210 and the lid 205 to either open (counterclockwise) or close (clockwise) the container 201.

The subject matter of the present invention is defined by the following claims.

The invention claimed is:

1. A large aperture resealable container having at least one top and one bottom surface, said container including in combination:

(a) an enclosure having a transmural aperture within an annular shoulder extending outward from a surface of said container, said shoulder having (i) pre-determined inside and outside diameters and (ii) a plurality of pins extending radially outward from the outside diameter thereof;

(b) a lid for enclosing said aperture, said lid including a tubular wall extending from an inner surface of said lid, said tubular wall having (i) an open end located a predetermined distance from the inner surface of said lid, (ii) an inside diameter suitable for sliding over the outside diameter of said shoulder; (iii) a circumferential flange extending radially outward from the open end of said tubular wall; and (iv) a plurality of slots through said wall and through at least a portion of said flange to receive said pins when the lid is placed over the shoulder to enclose said aperture;

(c) a collar for rotational displacement around the tubular wall of said lid while bearing on the flange extending from the open end of said wall, said collar including a plurality of tapered surfaces extending radially inward from an inside diameter of said collar, each of said tapered surfaces corresponding to one of said plurality of pins and disposed to move between the corresponding pin and said flange in response to rotation of said collar, said tapered surfaces adapted to force said pins away from said flange as the collar is rotated in a first direction relative to said enclosure;

(d) mating sealing surfaces disposed in axial opposition to one another and separately located on (i) the annular shoulder extending from said enclosure and (ii) the inner surface of said lid, said sealing surfaces being aligned and drawn together when the lid and collar are engaged over the aperture and the collar is rotated in said first direction;

(e) at least one first protrusion secured to said collar for receiving manual forces to rotate said collar in said first direction; and, (f) at least one second protrusion secured to said collar for receiving manual forces to rotate said collar in a second direction opposite to said first direction;

whereby the transmural aperture in the enclosure is sealed by placing said lid over the annular shoulder with the pins engaged within their corresponding slots in the tubular wall of said lid and applying force to at least one of said first protrusions to rotate said collar in said first direction and to thereby advance the corresponding tapered surfaces between the pins on the shoulder and the flange on said lid to draw the opposed sealing surfaces into predetermined proximity.

2. The container of claim 1 further including at least one fixed protrusion secured against rotation relative to said enclosure for receiving manual pinch forces applied to at least one of said first protrusions to rotate said collar in said first direction.

3. The container of claim 2 further including at least one protrusion secured against rotation relative to said enclosure for receiving manual pinch forces applied in relation to at least one of said second protrusions to rotate said collar in said second direction.

4. The container of claim 3 wherein the protrusions subject to pinch forces include complementary surface configurations that visually indicate when the collar has rotated to a predetermined limit in said first direction.

5. The container of claim 4 further including a visible link for restricting movement between the protrusions subjected to manual pinch forces when the collar has rotated to a predetermined limit in said first direction.

6. The container of claim 5 wherein removal, of the visible link requires substantially irreversible functional damage to said link.

7. The container of claim 1 wherein (a) the lid is located on a top surface of the enclosure and (b) a bottom surface of the enclosure includes a recessed area for receiving and laterally retaining the lid of another such container when assembled together in a vertically stacked arrangement.

8. The container of claim 7 wherein said recessed area receives the lid of another such container only when the collar on said other container is rotated to a predetermined position relative to the enclosure.

9. The container of claim 1 wherein opposing sides of the enclosure include complementary surface configurations for limiting lateral displacement along mated sides of contiguous containers in an assembly of such containers.

10. The container of claim 9 wherein the sides of the enclosure define a generally cylindrical form having a cross-sectional shape corresponding to a shape selected from the group including a circle, equilateral triangle, square, rectangle, hexagon and octagon.

11. The container of claim 10 wherein the enclosure has a generally rectangular shape with a length to width ratio of approximately 2 to 1.

12. The container of claim 7 wherein opposing surfaces of the enclosure include complementary surface configurations for limiting lateral displacement along mated sides of contiguous containers in an assembly of such containers.

13. The container of claim 10 wherein selected pairs of mating sides of the enclosure include complementary surface configurations for limiting lateral displacement along said mated sides of contiguous containers in an assembly of such containers.

14. The container of claim 1 further including a deformable gasket material disposed between said opposing sealing surfaces.

15. The container of claim 14 wherein the gasket material is compressed to substantially inhibit fluid flow through the aperture when the collar is rotated to a predetermined limit in said first direction.

16. An assembly of the containers described in claim 7 wherein at least two of said containers are in stacked relation with the lid of one container nested within said recessed area in the bottom of a vertically adjacent container.

17. An assembly of the containers described in claim 9 wherein at least two of said containers are in side-by-side contact and said complementary surface configurations are in mated relation to one another.

18. An assembly of the containers described in claim 12 wherein (i) at least two of said containers are in stacked relation with the lid of one container nested within said recessed area in a bottom surface of a vertically adjacent container and (ii) at least two of said containers are in side-by-side contact and said complementary surface configurations are in mated relation to one another.

19. An assembly of the containers described in claim 10, said containers having enclosures of different heights and wherein a height of the tallest enclosure in the assembly of containers is an integer multiple of a height of shorter enclosures included in the assembly of containers.

* * * * *